United States Patent [19]

Halamoda et al.

[11] Patent Number: 5,076,074

[45] Date of Patent: Dec. 31, 1991

[54] TOOL FOR A KNITTING MACHINE

[75] Inventors: Hans-Joachim Halamoda, Albstadt; Albert Teufel, Veringenstadt, both of Fed. Rep. of Germany

[73] Assignee: Theodor Groz & Sohne & Ernst Beckert Nadelfabrik Commandit-Gesellschaft, Albstadt-Ebingen, Fed. Rep. of Germany

[21] Appl. No.: 523,023

[22] Filed: May 14, 1990

[30] Foreign Application Priority Data

May 13, 1989 [DE] Fed. Rep. of Germany ..... 3915684

[51] Int. Cl.[5] ..... D04B 35/02

[52] U.S. Cl. ..... 66/90; 66/123; 66/124

[58] Field of Search ..... 66/24, 90, 107, 123, 66/124, 220

[56] References Cited

U.S. PATENT DOCUMENTS

| | | | |
|---|---|---|---|
| 763,400 | 6/1904 | Hurley et al. | 66/123 |
| 1,015,108 | 1/1912 | Williams | 66/123 |
| 1,940,520 | 12/1933 | Zimic | 66/124 |
| 2,024,911 | 12/1935 | Crawford | 66/124 |
| 2,219,600 | 10/1940 | Potter | 66/124 |
| 2,431,635 | 11/1947 | Currier | 66/123 |
| 3,643,472 | 2/1972 | Apprich | 66/106 |

FOREIGN PATENT DOCUMENTS 2327585 12/1974 Fed. Rep. of Germany .

*Primary Examiner*—Werner H. Schroeder
*Assistant Examiner*—John J. Calvert
*Attorney, Agent, or Firm*—Spencer & Frank

[57] ABSTRACT

A knitting tool, such as a selector sinker or a needle for a knitting machine, includes a flat shank and a narrow elongate control spring projecting from a slot-like opening in a narrow side of the shank. One end of the control spring has a broader anchorage section at one end which is inserted into a recess provided at an inward end of the opening in the shank. The width of the recess, measured transversely to the longitudinal extent of the opening, is greater, at least at certain locations, than the width of the opening. The thickness of the anchorage section of the control spring is less than or equal to the depth of the recess. As a result, the control spring is rigidly anchored in the shank in a manner secure against rotation.

22 Claims, 2 Drawing Sheets

TOOL FOR A KNITTING MACHINE

REFERENCE TO RELATED APPLICATIONS

This application claims the priority of Federal Republic of Germany application Serial No. P 39 15 684.2 filed May 13, 1989, which is incorporated herein by reference.

BACKGROUND OF THE INVENTION

1. Field of the Invention

The present invention relates to a knitting tool, for example a selector sinker or a needle for a knitting machine, which has a flat shank and a narrow elongate control spring projecting therefrom. The control spring is disposed in a projecting manner in the region of a narrow side of the shank with one end of the control spring rigidly anchored in a slot-like opening in the shank which is oriented toward this narrow side.

2. Description of the Prior Art

DE-OS 1,585,211 discloses a circular knitting machine which performs electronic needle selection. The needles are controlled by pushers in the form of electromagnetically controlled selector sinkers which are pivoted radially back and forth, according to the pattern of the product to be knit. The selector sinkers are pivoted between an effective position and an ineffective position to thus be brought into and out of engagement with a cam track. A respective control spring projects from a narrow side of each selector sinker. Each control spring is in the form of a spring rod having one end anchored to the shank of the selector sinker. At its free end, the control spring is supported at an abutment on the needle cylinder and functions to reset the selector sinker.

In order to anchor the control spring in the shank of the selector sinker, an end section of the control spring is bent approximately in the manner of a hairpin and one arm of it is pressed into a slot-like opening in the shank. The opening becomes wider toward its inward end and the end section is clamped in the opening.

Since the end section of the control spring is merely clamped into the slot-like opening of the shank of the selector sinker and thus is held under tension in a friction lock, a danger exists that during long periods of operation, high dynamic stresses may cause the end section of the control spring to work itself to some extent laterally out of the slot-like opening, with the result that additional friction occurs in the associated guide channel for the needle and the selector sinker. This is undesirable. Moreover, uncontrolled changes in dimensions occasionally may occur in the position of the control spring relative to the selector sinker. This also adversely influences the operation of the knitting machine.

The same applies in principle to the selector sinker illustrated in FIG. 10 of U.S. Pat. No. 3,643,472. This selector sinker has a control spring which is clamped at one end into an opening extending with parallel sides approximately at a right angle to the longitudinal axis of the sinker. The spring is secured against movement in its axial direction by an end piece that is bent at a right angle. The opening therefore must have an essentially L-shape, which is not easy to produce from a manufacturing point of view.

Finally, DE-OS 2,327,585 discloses a circular knitting machine which operates with needles whose shanks are provided, for magnetic needle selection, with respective control springs which are anchored at one end. The control springs are manufactured of steel wire and have a circular cross section or are slightly rolled flat, that is, have flattened portions, or are punched out of thin spring steel sheet metal. The end section of each spring is fitted into a slot defined by parallel flanks in a corresponding needle shank, with individual, spaced embossed locations provided on the side walls of the slot. The end section is wedged into the slot to fix it in place. Although this produces a form-locking connection between the end of the control spring and the needle shank, the spaced embossed locations on the side walls of the slot do not ensure precise lateral alignment of the control spring relative to the needle shank. The end section of the control spring is hardened and is therefore not deformed during the wedging. Therefore, in this arrangement also the end section of the control spring could, over the course of time, be caused by the high dynamic stresses thereon to be worked somewhat free of the wedging, thus making the entire control spring rotationally movable, within limits, at its anchorage point. Moreover, the danger exists that the transverse forces generated during the wedging might widen the slot, in which case the upright dimension of the shank could be changed in an uncontrollable manner.

SUMMARY OF THE INVENTION

It is therefore an object of the invention to provide a knitting tool equipped with a control spring which is anchored at one end, is rotationally secure and has an accurate anchorage in the shank, the anchorage being secure even under high dynamic stresses over long periods of operation. It is a further object to provide a knitting tool having these properties, which can be manufactured economically.

Such a knitting tool according to the invention includes a flat shank having a narrow side. A slot-like opening extends in a longitudinal direction into the narrow side. A recess is formed at an inward end of the opening. The recess has a width measured in a transverse direction which is greater, at least at some locations, than the width of the opening. A narrow elongated control spring projects from the slot-like opening. An end section of the spring which is in the opening has an anchorage section fitted in the recess so as to rigidly anchor the spring in the opening. The anchorage section is broadened in the transverse direction to have a width which corresponds to that of the recess. The anchorage section also has a thickness which is less than or equal to a depth of the recess. The control spring is laterally guided in the opening on at least one of its sides.

The location of the opening and of the recess ensures accurate alignment of the tool in a predetermined position. Since the recess is broader than the opening, the control spring is form-lockingly arrested in the longitudinal direction by means of its broadened anchorage section. At the same time, the broadened anchorage section prevents inadvertent rotation of the control spring. Finally, installation of the control spring can be effected very accurately in the intended position because the recess ensures an unequivocal, fixed association of the control spring and the shank. Thus, it is also possible to positively align the control spring if this should be advisable in an individual case. The control spring may be installed by the manufacturer and—if necessary—it is possible to attach different control springs to a shank without modifying the latter.

In a preferred embodiment, the recess in the shank is groove-like and has an essentially planar bottom face, and the anchorage section has an associated, corresponding contact face that is planar at least in certain regions. The groove-like recess and the anchorage section may also be provided with parallel side walls, which substantially facilitates the manufacture and installation of the tool. Particularly in consideration of the manufacturing process, the opening may be linear and the recess may advantageously be disposed symmetrically with respect to the longitudinal axis of the opening, as an extension of the opening. However, in principle, other embodiments are of course possible in which the recess is provided, for example, at an angle to the axis of the linear opening. The recess itself may also have configurations which differ from a groove shape, for example a circular shape, to mention only one other possibility.

The anchorage section is disposed at the end of the control spring, generally recessed with respect to only one side face of the end section of the control spring, and may be formed in a simple manner by pressing the end section. In a preferred embodiment, both the depth of the recess and the thickness of the anchorage section are approximately equal to one-half the thickness of the shank. However, depending on such variables as stress conditions, other depth and thickness dimensions may be desirable.

The recess may advantageously follow the opening by way of sloped or rounded lateral shoulders. Such shoulders facilitate fitting and avoid sharp edges.

If clamping the control spring tightly into the shank on both sides over a certain length is important, the control spring is laterally guided in the opening on both sides. However, there are also selector sinkers or needles in which a lower bending strength of the control spring is desired in the region where it is clamped in. In such cases the opening may be, for example, laterally set back relative to the control spring, over a section of predetermined length starting from where the opening enters the narrow side of the shank. This laterally setback section may, if necessary, extend to the recess itself. In such as case, one side wall of the opening produces merely unilateral guidance of the control spring.

In principle, it is possible to connect the end section of the control spring with the shank merely by pressing the end section and the anchorage section into the opening and the recess, respectively, where they are there held, under tension, with a friction lock. In that case it is even possible, if required, to arrange the control spring at the shank so that it can be exchanged. Advisably, however, the end section of the control spring is firmly connected with the shank. This can be realized advantageously by welding, soldering, gluing the anchorage section to the shank, or by fastening the anchorage section to the shank in a form-locking manner, for example by wedging.

Knitting tools to which a control spring can be fastened in the described manner include needles, sinkers, pushers, jack selectors and any other components which may serve to form stitches or participate in the formation of stitches, and which are required to be equipped with such a control spring.

BRIEF DESCRIPTION OF THE DRAWINGS

These and other features and advantages of the invention may be more completely understood from the following detailed description of the preferred embodiments of the invention with reference to the accompanying drawings in which:

FIG. 7(*a*) is a cross-sectional view of the control spring of FIG. 7, as seen along line VII(*a*)—VII(*a*) in FIG. 7;

FIG. 7(*b*) is a cross-sectional view of the anchorage section of FIG. 7, as seen along line VII(*b*)—VII(*b*) in FIG. 7.

DESCRIPTION OF THE PREFERRED EMBODIMENTS

Figures 1, 2, 3, 4, 5, 6:
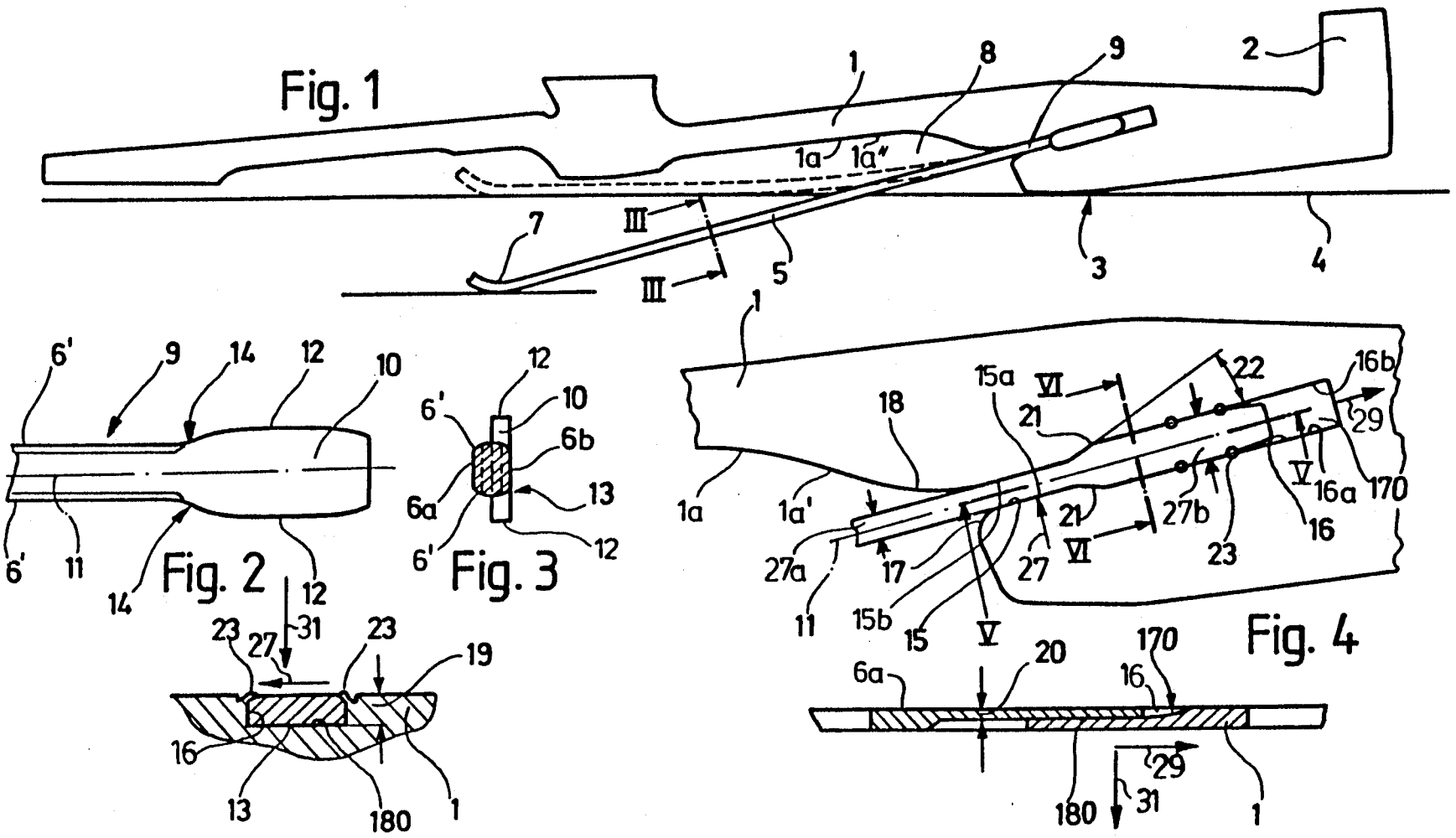
FIG. 1 is a side view of a knitting tool according to the invention, in the form of a selector sinker.
FIG. 2 is an enlarged partial top view of the end section and the broadened anchorage section of the control spring for the knitting tool of FIG. 1.
FIG. 3 is an enlarged cross-sectional view of the control spring of the knitting tool of FIG. 1, as seen along line III—III of FIG. 1.
FIG. 4 is an enlarged partial view of the shank and the control spring of the knitting tool of FIG. 1, showing the manner in which the control spring is fastened to the shank.
FIG. 5 is an enlarged sectional view of the arrangement of FIG. 4 as seen along line V—V in FIG. 4.
FIG. 6 is an enlarged cross-sectional view of the arrangement of FIG. 4, seen along line VI—VI in FIG. 4.
Figures 7, 7A, 7B, 8:
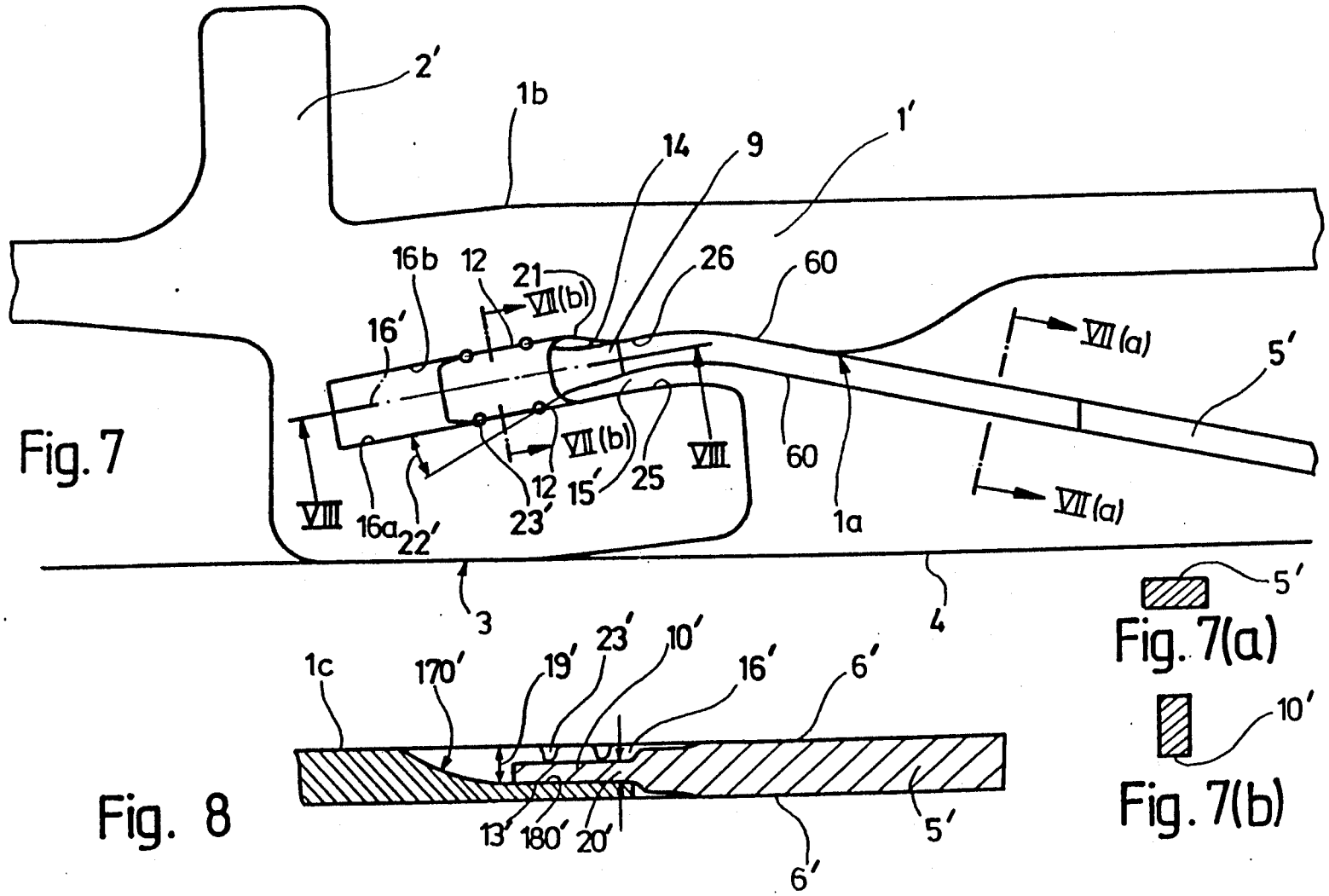
FIG. 7 is a side view, partially in section, of a further embodiment of the knitting tool according to the invention, in the form of a selector sinker.
FIG. 8 is an enlarged sectional view of the knitting tool of FIG. 7, as seen along line VIII—VIII in FIG. 7.

FIGS. 1 and 7 illustrate two embodiments of a knitting tool in the form of a so-called selector sinker for a circular knitting machine equipped with electromagnetic needle selection. Such selector sinkers may be used, for example, in the circular knitting machine disclosed in DE-PS 3,712,673.

Referring to FIG. 1, aside from elements not of interest here, the selector sinker includes a flat shank 1 to which is attached a control butt 2 by way of which the selector sinker is pivoted while supported in the machine on the bottom 4 of an associated guide groove in a needle or sinker cylinder at a pivot point 3 on the lower narrow side 1*a* of the shank opposite the control butt 2. The shank 1 is punched from sheet steel. In the region of the narrow side opposite the control butt 2, a narrow elongated control spring 5 has one end anchored to the shank 1 so as to project from it. The width of the control spring 5 essentially corresponds to the thickness of the shank 1. The spring is oriented parallel to the shank 1.

In the embodiment of FIGS. 1 to 6, the control spring 5 is composed of a circular spring steel wire that is flattened on opposite sides 6*a* and 6*b* (FIG. 3). The free end of the spring 5 is slightly rounded at 7, and with the selector sinker installed in the machine, lies at the bottom 4 of the guide groove. The underside of the shank 1 is provided with an open-edge recess 8 below which the control spring 5 extends and into which it can elastically bend as shown in dashed lines in FIG. 1, if the selector sinker is pivoted out or tilted. The recess 8 is defined by a curved surface 1*a*″ of the lower narrow side 1*a*.

The end section 9 of the control spring 5 is firmly anchored to the shank 1 in a region of the recess 8. The shape of the end section 9 is shown in detail in FIGS. 2, 3 and 6. An end of the end section 9 has a broadened anchorage section 10 which is disposed symmetrically to the longitudinal center plane 11 of the control spring 5 as shown in FIG. 2. The anchorage section may be produced by pressing on one side the spring steel wire forming the control spring 5. As can be seen in FIGS. 3 and 5, the anchorage section 10 has essentially parallel and linear flank surfaces 12 and is recessed only with respect to one of the two flattened side faces of the end section 9, i.e., side face 6a. The anchorage section 10 is, however, flush with the other flattened side face 6b and thus forms a planar contact surface 13. Finally, the two essentially linear flank faces 12 of anchorage section 10 curve at 14 in a rounded manner into the two rounded side faces 6' connecting the flattened side faces 6a and 6b of the end section 9.

On the lower narrow side 1a of the shank 1, there is formed a slot-like opening 15 which extends in a longitudinal direction 29 of a center axis in the center plane 11, has parallel flank surfaces 15a and 15b and opens toward the recess 8 (see FIG. 4). The opening 15 is followed in the linear extension of its longitudinal axis by a groove-like recess 16, likewise having parallel flank surfaces 16a and 16b, cut from one broadside into the shank 1. The slot-like opening 15, opens into the recess 8, along rounded edges 17 and 18. The width 27a of the opening 15, measured in a direction 27 which is perpendicular (transverse) to the longitudinal direction 29 corresponds within close tolerances to the thickness of the end section 9 of the control spring 5 measured at a right angle to the faces 6a and 6b (FIG. 3). The width 27b of the recess 16 measured in the transverse direction 27 is greater than the width 27a of the opening 15. The recess 16 has a bent milling tool exit section 170, followed by a planar bottom face 180 over the major portion of its length, with such planar bottom face extending symmetrically on both sides of its center axis (this axis also being in the plane 11 in FIG. 4). As shown in FIGS. 5 and 6, the bottom face 180 of the recess 16 faces transversely to the transverse direction 27 and the longitudinal direction 29 and supports the anchorage section 10. The depth 19 of the recess 16 and the thickness 20 of the anchorage section 10, measured in a direction 31 transverse to the transverse direction 27 and the longitudinal direction 29, are each about equal to one-half the thickness of the flat shank 1. The thickness 20 is no greater than the depth 19.

The flat anchorage section 10 of the control spring 5 is fitted within close tolerances into the recess 16 in a manner shown, in particular, in FIGS. 1 and 4, while the region of the end section 9 following anchorage section 10 is accommodated, likewise within close tolerances, in the slot-like opening 15 in such a manner that it is guided on both sides without play by a section of the side walls 15a and 15b of the opening 15 of predetermined length, beginning at the exterior surface 1a' of the bottom narrow side 1a. The outline configuration of the anchorage section 10, including its sloped transitions 14, is designed so that its interaction with the conforming boundaries of the recess 16, including the side walls 16a and 16b, and the shoulders 21 which extend in a wedge-like manner at an acute angle 22, ensures an accurate axial arrest of the anchorage section 10, and thus of the control spring 5, in the shank 1. Since the anchorage section 10 is pressed flat, starting from the face 6a of the control spring 5, the end section 9 lies symmetrically in the middle of the opening 15 while no projecting faces exist at the two opposing broadsides of the shank 1, as clearly shown in FIG. 5.

The anchorage section 10 is fixed in the recess 16 in a form-locking manner by means of wedging 23 formed by deforming the portions of edges of the recess 16 as is shown in FIG. 6. Instead of or in addition to the wedging 23, the anchorage section 10 in the recess 16 could also be fastened to the shank 1 by soldering or welding.

Embodiments are also possible in which there is no fastening by such means as wedging, welding or soldering, and in which the anchorage section 10 is merely pressed into the recess 16 with a slight overdimension so that a friction lock fixation under tension results.

The embodiment according to FIG. 7, wherein the same reference designate the same or corresponding components in FIGS. 1 to 6, is now described. In contrast to the embodiment of FIGS. 1 to 6, the control spring 5' here has a flat profile as this is indicated in the cross-sectional view of FIG. 7(a). One end of the control spring 5' is fastened to the shank 1 in such a manner that its two broadsides 60 are oriented parallel to the adjacent lower narrow side 1a of the shank 1. The slot-like opening 15' is broader than the control spring 5' in that its side wall 25 remote from the upper side lb of the shank 1' is set back relative to control spring 5'. Moreover, the control spring 5' is supported on the opposite side wall 26 of the opening 15' and is guided along the latter to follow its curvature.

The laterally set-back section of the side wall 25 of the opening 15' extends to the groove-like recess 16' whose depth 19' in this case is greater than one-half the thickness of the shank 1. As can be seen in FIG. 8, the pressed, broadened anchorage section 10' of the end section 9 is recessed relative to both side surfaces 6' of the end section 9. The anchorage section 10' is, moreover, set below the broadside 1c into which the recess 16' is formed, this being possible since the thickness 20' of the anchorage section is less than the depth 19' of the recess 16'. The anchorage section 10' is fixed in the recess 16', again by wedging 23'. The control spring 5' is arrested in the longitudinal direction of the recess 16' by the shaping of the side wall 26 which cooperates with a corresponding curvature of the control spring 5'. Moreover, the anchorage section 10' is also laterally defined by parallel flank surfaces. The contact face 13' of the anchorage section 10' is planar, as is the utilized portion of the bottom face 180' of the recess 16 which supports the contact face 13'.

As can be seen from FIG. 7, the control spring 5' has the shape of a spring latch; a corresponding configuration could also be selected for the control spring 5' in the embodiment according to FIGS. 1 to 6.

In both described embodiments, the recess is formed by a groove-like cut-out in the shank 1. As an alternative, embodiments are possible in which the recess is, for example, circular in the form of a blind bore or has another appropriate outline configuration. In any case, the anchorage section has a shape which corresponds to the outline configuration of the recess so that it can be fitted in the recess within close tolerances. It must be ensured that the recess and the anchorage section are broader than the opening, at least at some locations, so that a form-locking arrest in the direction of the longitudinal extent of the opening is ensured by the difference in width between the opening and the recess. The broader anchorage section generally has an approximately rectangular cross section, as shown in FIG. 7(b).

However, it could also be spherical or have some other shape in the direction toward the bottom of the recess.

It will be understood that the above description of the present invention is susceptible to various modifications, changes and adaptations, and the same are intended to be comprehended within the meaning and range of equivalents of the appended claims.

What is claimed is:

1. A knitting tool for use on a knitting machine, comprising a flat shank having a narrow side, a slot-like opening extending in a longitudinal direction into said narrow side, and a recess formed at an inward end of said opening, said opening having a width measured in a transverse direction which is transverse to the longitudinal direction, said recess having a width, measured in said transverse direction, which is greater, at least at some locations, than said width of said opening; and a narrow elongated control spring projecting from said narrow side, said spring having one end inserted into said slot-like opening and being rigidly anchored therein, said spring having an end section at said one end, said end section having an anchorage section fitted in said recess, said anchorage section being broadened in said transverse direction to have a width which corresponds to said width of said recess, said anchorage section having a thickness measured transversely to said transverse and longitudinal directions which is no greater than a depth of said recess measured transversely to said transverse and longitudinal directions, said recess having a bottom face facing transversely to said transverse and longitudinal directions, said bottom face supporting said anchorage section; said opening having means laterally guiding said spring on at least one side of said spring.

2. A knitting tool as in claim 1, wherein the bottom face is substantially planar, said anchorage section including a contact surface having planar regions which are flush with said bottom face.

3. A knitting tool as in claim 1, wherein said recess and said anchorage section each have parallel side walls.

4. A knitting tool as in claim 1, wherein said opening is linear and has a longitudinal axis and said recess is disposed in an extension of said linear opening and disposed symmetrically with respect to said longitudinal axis.

5. A knitting tool as in claim 1, wherein said end section of said control spring has opposite side faces, said anchorage section being recessed relative to only one of said opposite side faces.

6. A knitting tool as in claim 5, wherein said anchorage section is flattened relative to a remaining portion of said end section.

7. A knitting tool as in claim 1, wherein said opening is bounded by sloped lateral shoulders in a region adjacent to said recess, such that said opening widens as it approaches said recess.

8. A knitting tool as in claim 1, wherein said opening is bounded by lateral shoulders in a region adjacent to said recess, shaped such that said opening widens as it approaches said recess.

9. A knitting tool as in claim 1, wherein said means laterally guiding said spring is a side surface of said opening disposed on one side of said control spring and said opening has a further side surface on a side of said control spring opposite said one side, said further side surface extending in said longitudinal direction from an exterior surface of said narrow side of said shank, said further side surface being laterally set back relative to said control spring over a predetermined length section of said further side surface, said predetermined length section beginning at said exterior surface of said narrow side of said shank.

10. A knitting tool as in claim 9, wherein said predetermined length section extends to said recess.

11. A knitting tool as in claim 1, wherein said anchorage section is non-releasably fastened to said shank.

12. A knitting tool as in claim 11, wherein said anchorage section is welded to said shank.

13. A knitting tool as defined in claim 11, wherein said anchorage section is form-lockingly fastened to said shank.

14. A knitting tool as in claim 11, wherein said shank has means for wedging said anchorage section in said recess so as to form-lockingly fasten said anchorage section to said shank.

15. A knitting tool as in claim 1, wherein said depth of said recess and said thickness of said anchorage section are approximately equal to one-half of a thickness of said shank measured transversely to said transverse and longitudinal directions.

16. A knitting tool as in claim 1, wherein said control spring comprises an elongated flat spring having a free end opposite said one end, said free end being rounded.

17. A knitting tool as in claim 1, including a selector sinker, said selector sinker including said shank and said spring.

18. A knitting tool as in claim 11, wherein said anchorage section is soldered to said shank.

19. A knitting tool as in claim 11, wherein said anchorage section is glued to said shank.

20. A knitting tool as in claim 1, wherein said spring has a free portion exterior to said opening, said free portion being spaced from said narrow side and being elastically bendable toward said narrow side.

21. A knitting tool as in claim 20, wherein said narrow side is bounded by a curved surface defining an open edge recess, said free portion being elastically bendable into said open edge recess.

22. A knitting tool as in claim 1, wherein said spring comprises a spring steel wire which is flattened on opposite sides.

* * * * *